US005448130A

United States Patent [19]

Matsutani et al.

[11] Patent Number: 5,448,130

[45] Date of Patent: Sep. 5, 1995

[54] SPARK PLUG ELECTRODE FOR USE IN INTERNAL COMBUSTION ENGINE

[75] Inventors: Wataru Matsutani; Mamoru Musasa, both of Nagoya, Japan

[73] Assignee: NGK Spark Plug Co., Ltd., Nagoya, Japan

[21] Appl. No.: 233,773

[22] Filed: Apr. 26, 1994

[30] Foreign Application Priority Data

Apr. 26, 1993 [JP] Japan ..... 5-099864

[51] Int. Cl.[6] ..... H01T 13/20

[52] U.S. Cl. ..... 313/141; 313/142

[58] Field of Search ..... 313/141, 142

[56] References Cited

U.S. PATENT DOCUMENTS 4,581,558 4/1986 Takamura et al. ..... 313/141
5,101,135 3/1992 Oshima ..... 313/142
5,347,193 9/1994 Oshima et al. ..... 313/142

FOREIGN PATENT DOCUMENTS 2-500704 3/1990 Japan .

*Primary Examiner*—Sandra L. O'Shea
*Assistant Examiner*—Matthew J. Esserman
*Attorney, Agent, or Firm*—Sughrue, Mion, Zinn, Macpeak & Seas

[57] ABSTRACT

In a spark plug electrode in which an alloyed tip is secured to a firing end of one of opposed electrodes forming a spark gap therebetween, the tip has a spark-erosion resistant noble metal component, and the noble metal component varies as a weight percentage of the alloyed tip in an axial direction of the electrode depending on a magnitude of spark discharges to which a specified portion of the tip is subjected between the opposed electrodes, wherein a largest weight percentage of the noble metal component is provided at areas on the electrode subjected to relatively high magnitude spark discharges, and wherein a smallest weight percentage of the noble metal component is provided at areas on the electrode subjected to relatively low magnitude spark discharges.

9 Claims, 11 Drawing Sheets

SPARK PLUG ELECTRODE FOR USE IN INTERNAL COMBUSTION ENGINE

BACKGROUND OF THE INVENTION

1. Field of the Invention

This invention relates to a spark plug electrode in which a spark-erosion resistant noble metal containing tip is secured to a firing end of a center or ground electrode, and particularly to an improved spark plug electrode in which a noble metal component of the tip is altered depending on a total magnitude of the spark discharges to which a specified portion of the tip is subjected.

2. Description of Prior Art

With the recent demand of enhancing a spark-erosion resistant property of an electrode for use in an internal combustion engine, Japanese Patent Publication No. 62-31797 introduces a technique in which annular noble metal tips 103, 104 in turn cover firing ends of center electrode metals 101, 102 of multi-polarity type and semi-creeping discharge type spark plugs 100, 100*a* as shown in FIGS. 11 and Due to the positional relationship between the center electrode metals 101, 102 and ground electrode 105, 106, the tips 103, 104 tend to be locally eroded in a manner as shown at a left half in FIGS. 11 and 12. The spark erosion makes spark gaps 107, 108 unacceptably greater to exhaust service life of the spark plug, and an expensive noble metal component of the tip partially remains uneroded so as to make the technique uneconomical.

In order to avoid the uneconomical disadvantage, it is considered to previously leave out an uneroded part of the noble metal tip as shown at the left half 109 in FIG. 13*a*.

However, the center electrode metal 101 is spark eroded significantly as spark discharges repeatedly occur between the electrodes as shown in FIGS. 13*b* through 13*d*. This makes the service life of the spark plug 110 increasingly shorter than that of the spark plugs 100, 100*a*.

This is because the spark discharges presumably occur to the portion 109 of the electrode 101 in which the noble metal tip 103 is left out although a total magnitude of spark discharges is substantially limited when compared to the portion to which the noble metal tip 103 is subjected.

Therefore, it is an object of the invention to provide a spark plug electrode for use in an internal combustion engine which is capable of controlling a rapid spark erosion of an electrode to which a limited magnitude of spark discharges is subjected while maintaining an economical advantage by substantially reducing a quantity of noble metal component used for a portion of the electrode to which the limited magnitude of spark discharges is subjected.

SUMMARY OF THE INVENTION

According to the invention, there is provided a spark plug electrode in which an alloyed tip is secured to a firing end of one of opposed electrodes which forms a spark gap therebetween. The alloyed tip has a noble metal component varied in an axial direction of the electrode depending on a magnitude of spark discharges to which a specified portion of the tip is subjected between the opposed electrodes.

In this instance, it is desirable to predetermine that a difference between an upper limit and lower limit of the noble metal component of the alloyed tip is 10% by weight or more.

According to the invention, there is provided a spark plug electrode in which an alloyed tip is secured to a firing end of one of opposed electrodes which forms a spark gap therebetween. The alloyed tip has a noble metal component varied in an axial direction of the electrode depending on a quantity of spark erosion to which a specified portion of the tip is subjected between the opposed electrodes.

In this instance, it is also desirable to predetermine that a difference between an upper limit and lower limit of the noble metal component of the alloyed tip is 10% by weight or more. Further, the electrode has a clad metal and a heat-conductive core concentrically embedded in the clad metal. The clad metal is made of a corrosion and erosion resistant nickel alloy containing 15.0 wt % Cr and 8.0 wt % Fe, and the heat-conductive core is made of silver or copper.

With the alloyed tip having the noble metal component varied in the axial direction of the electrode depending on a magnitude of spark discharges to which the specified portion of the tip is subjected, it is possible to increase the noble metal component of the tip to the portion to which increasing spark discharges are subjected. Further, it is also possible to decrease the noble metal component of the tip to the portion to which the limited spark discharges are subjected. This ensures that there is no substantial difference between a quantity of spark erosion to which a low noble metal component of the tip is subjected and a quantity to which a high noble metal component of the tip is subjected. This apparently insures a uniform quantity of spark erosion all through the alloyed tip secured to an entire area of the firing end of the electrode, thus enabling an extended service life of the spark plug with a minimum quantity of noble metal.

With the alloyed tip having the noble metal component varied in the axial direction of the electrode depending on a quantity of spark erosion to which the specified portion of the tip is subjected, it is possible to increase the noble metal component of the tip to the portion to which increasing spark erosion is subjected. Further, it is also possible to decrease the noble metal component of the tip to the portion to which the limited spark erosion is subjected. This ensures that there is no substantial difference between a quantity of spark erosion to which a low noble metal component of the tip is subjected and a quantity to which a high noble metal component of the tip is subjected. This apparently insures a uniform quantity of spark erosion all through the alloyed tip secured to an entire area of the firing end of the electrode, thus enabling an extended service life of the spark plug with a minimum quantity of noble metal.

These and other objects and advantages of the invention will be apparent upon reference to the following specification, attendant claims and drawings.

DETAILED DESCRIPTION OF THE EMBODIMENT OF THE INVENTION

Figure 1:
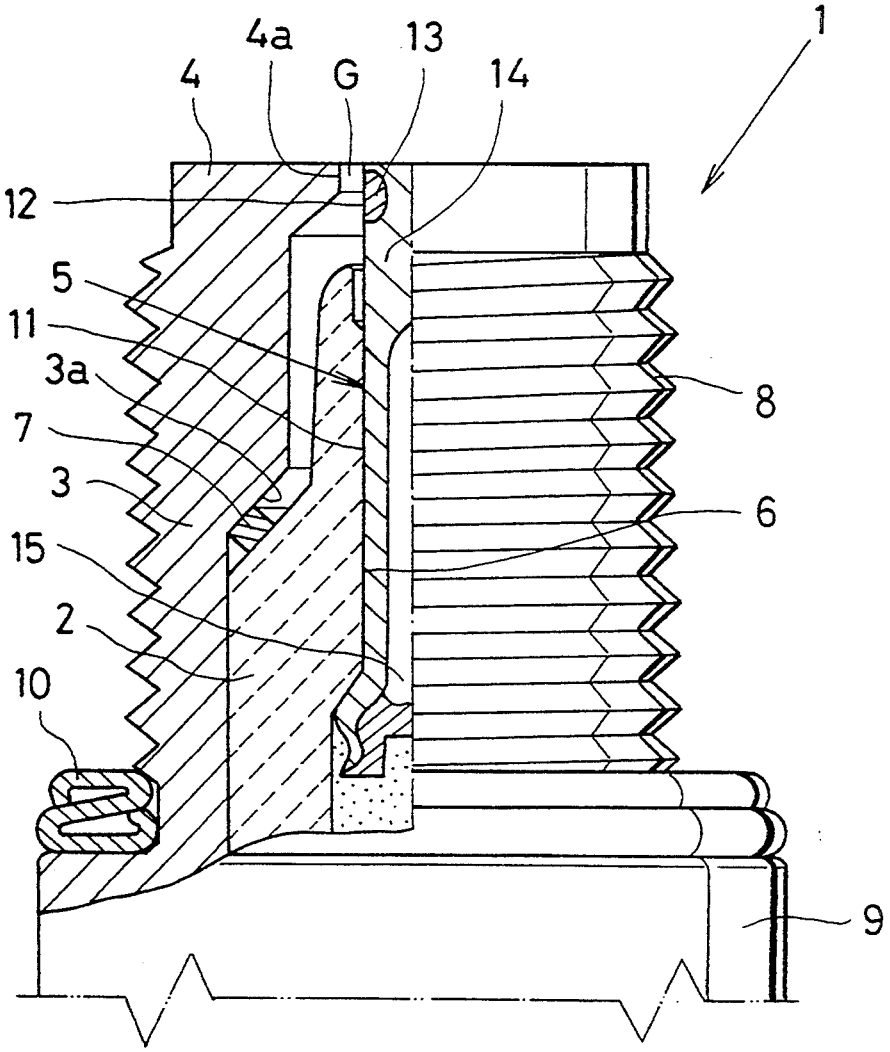
FIG. 1 is a plan view of a lower portion of a circular discharge type spark plug according to a first embodiment of the invention, its left half shown in section.
Figure 2:
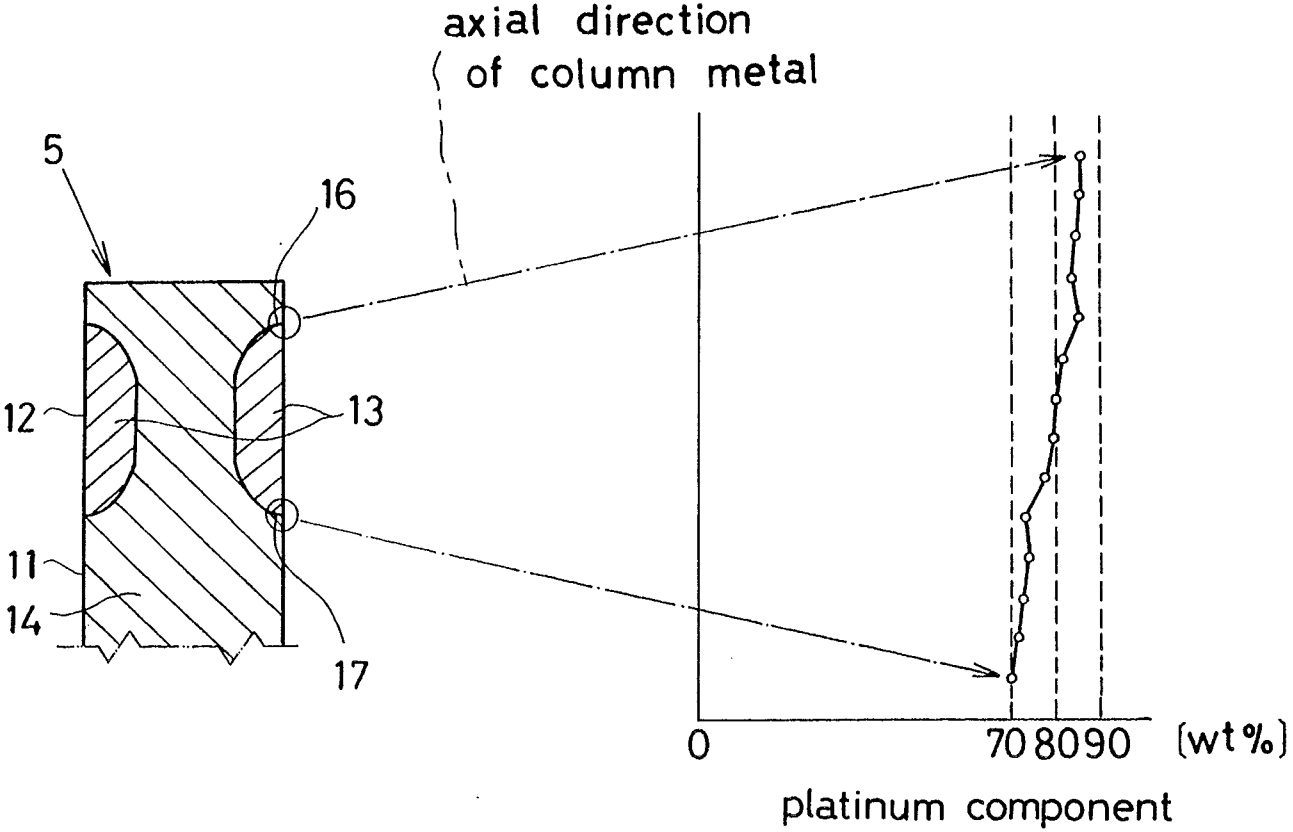
FIG. 2 is a graph showing a relationship between a platinum containing rate (wt %) and an axial position of a noble metal alloyed tip to which varied spark discharges are subjected.

Referring first to FIGS. 1 and 2 which show a lower portion of a circular discharge type spark plug 1 for use in an internal combustion engine according to a first embodiment of the invention, the spark plug 1 has a tubular insulator 2, and a metallic shell 3 in which the insulator 2 is placed. From a lower end of the metallic shell 3, a ring-shaped Ground electrode 4 is integrally extended. In a manner to be surrounded by an inner wall 4a of the ring-shaped Ground electrode 4, a lower portion of a center electrode 5 is arranged which is concentrically placed in the insulator 2. The insulator 2 is made of a sintered ceramic body such as, for example, alumina ($Al_2O_3$) with its inner space as an axial bore 6. The insulator 2 is further engaged against a shouldered inner wall 3a of the metallic shell 3 through a packing 7.

Meanwhile, the metallic shell 3 is made of an electrically conductive metal such as a low carbon steel or the like so as to form a housing of the circular discharge type spark plug 1. To an outer surface of the metallic shell 3, a male thread portion 8 is provided to secure the metallic shell 3 to a cylinder head (not shown) of the internal combustion engine. A gasket 10 is provided between barrel portion 9 of the metallic shell and the cylinder head so as to air-tightly seal a combustion chamber (not shown) of the internal combustion engine.

The lower end of the ground electrode 4 is arranged such as to oppose that of the center electrode 5, and being terminated short of the combustion chamber. Between the inner wall 4a of the ground electrode 4 and an outer surface of the center electrode 5, there is provided a spark gap G (e.g. 1.0 mm).

The electrode 5 has an elongated metal column 11 and a noble metal tip 13 secured to a firing end 12 of the center electrode 5 which establishes a spark discharge against the inner wall 4a of the ground electrode 4. The metal column 11 of the center electrode 5 has a clad metal 14 and a heat-conductive core 15 concentrically embedded in the clad metal 14. The clad metal 14 has a corrosion and erosion resistant nickel alloy containing 15.0 wt % Cr and 8.0 wt % Fe. The clad metal 14 is solidly supported in the insulator 2 with its lower end somewhat extended beyond the insulator 2. The core 15 is made of a heat-conductive metal such as silver, copper, copper-based alloy or the like.

As shown in FIG. 2, an increased quantity of the platinum component of the tip 13 resides in a portion corresponding to an upper limit 16 of the firing end 12 of the metal column 11. A decreased quantity of the platinum component of the tip 13 resides in a portion corresponding to a lower limit 17 of the firing end 12 of the metal column 11. The platinum component of the tip 13 is adapted to gradually change between the portions corresponding to the upper and lower limits of the firing end 12 of the metal column 11.

The greatest quantity of the platinum component of the tip 13 is approximately 85% by weight, while the smallest quantity of the platinum component of the tip 13 is approximately 70% by weight. Thus, a difference between upper and lower limits of the platinum component is about 15% by weight.

Figure 3A:
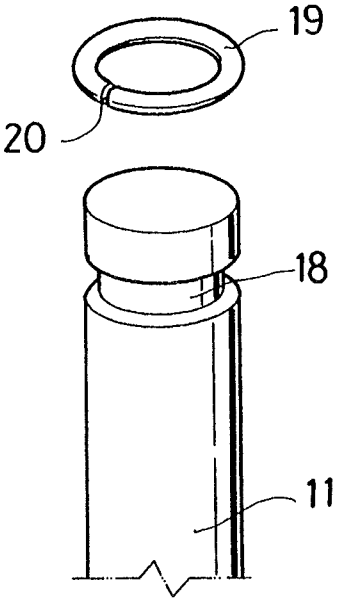
FIGS. 3a~3c are sequential views showing how the noble metal alloyed tip is secured to a center electrode.
Figure 3B:
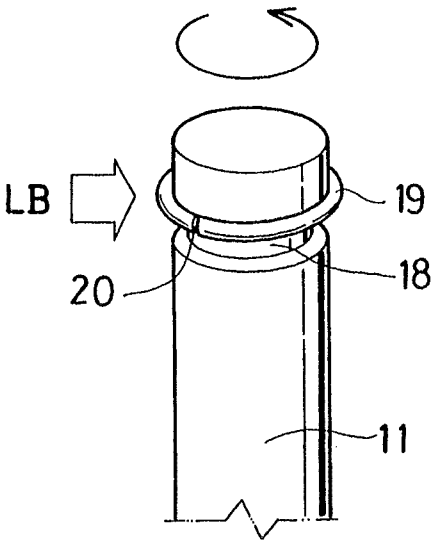
Figure 3C:
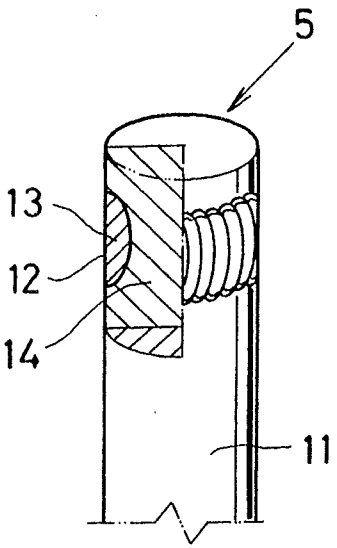
Figure 4A:
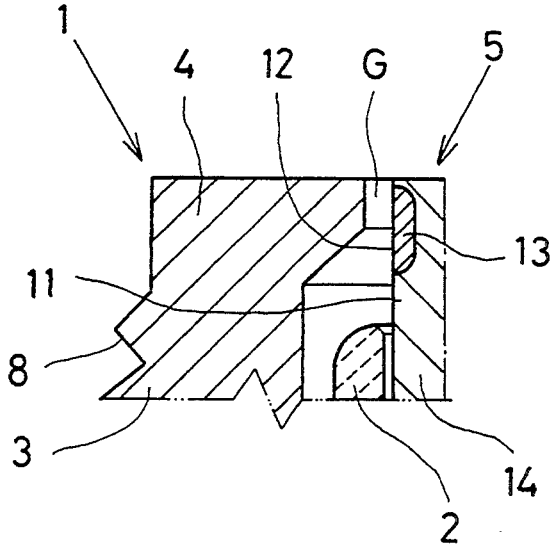
FIGS. 4a and 4b are longitudinal cross sectional views of the lower portion of the circular discharge type spark plug showing how the tip is spark eroded.
Figure 4B:
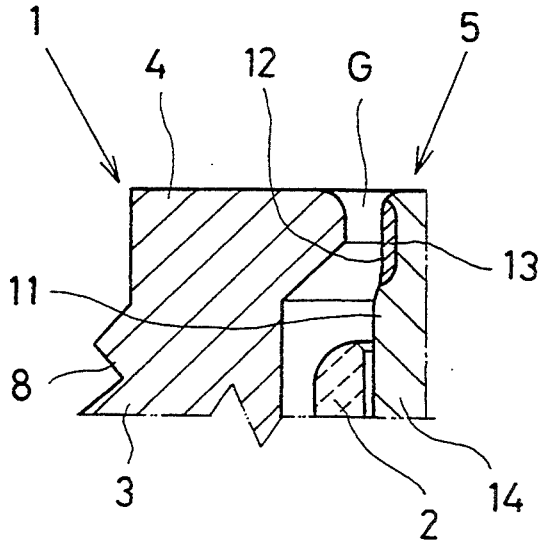

The following is a method for securing the tip 13 to the firing end 12 of the column metal 11 of the center electrode 5 (FIGS. 3a~3c).

An annular groove 18 is provided on the firing end 12 of the metal column 11 (2.5 mm in diameter) by means of milling or the like. The groove 18 is 0.6 mm in length and 0.15 mm in depth. A distance between the lower limit of the metal column 11 and a center of the groove 18 measures 1.5 mm. A noble metal wire 19 is made of platinum, and formed into an annular configuration, both ends of which meet in a manner to have a slit 20 therebetween. The noble metal wire 19 is circular in section and 0.3 mm in diameter. The noble metal wire 19 is arranged so that its volume is substantially the same as that of the groove 18.

After fitting the wire 19 into the groove 18 of the metal column 11, by means of electrical resistance welding, the wire 19 is provisionally secured to the side of the Groove 18 which corresponds to the upper limit of the firing end 12 subjected to the increased incidence of the spark discharges. Then, laser beams (LB) are applied perpendicular to the center of the groove 18 with a laser spot e.g. 1.4 mm in diameter as shown in FIG. 3b, the wire 19 is thermally fused into the column metal portion in which the groove 18 is located. In this instance, the metal column 11 is rotated around its axis at the speed of e.g. ($5\pi/6$) rad/sec, while at the same time, applying 48-round of the laser beams (LB) to the length of the wire 19 to carry out a seam welding.

Upon carrying out the seam welding, a laser welding machine is used to generate a pulse-type YAG laser with an underfocus 10 mm from an outer surface to the center of the metal column 11. The YAG laser is used with an output and pulse width 6.5 J and 2.0 milliseconds respectively. Instead of the YAG laser, a $CO_2$ laser may be used. Any type of welding may be used including electron beam welding so long as the wire is thermally fused into the groove 18 of the metal column 11.

By revolving the metal column 11 about its axis, the stationary wire 19 is automatically wound around the column 11, and the laser beams are applied to the wire 19 from its leading end to the successive portions continuously.

After applying the YAG laser welding to the noble metal wire 19, the noble metal tip 13 is provided on the firing end 12 in the form of an alloyed layer in which the nickel alloy component of the metal column 11 and the platinum component of the tip 13 are thermally fused as shown in FIG. 3*c*.

In this instance, the platinum component of the alloyed layer gradually increases from the lower limit to the upper limit of the metal column 11 as previously shown in FIG. 2.

With the structure thus far described, a high voltage is intermittently applied across the electrodes 4, 5 with the circular discharge type spark plug 1 mounted on the cylinder head of the internal combustion engine. The high voltage repeatedly induces the spark discharge between the inner wall 4*a* of the Ground electrode 4 and the noble metal tip 13 provided on the firing end 12 of the metal column 11.

As previously shown in FIG. 2, the platinum component of the tip 13 is increased in the direction in which the increased incidence of the spark discharges occurs, while the platinum component of the tip 13 is decreased in the direction in which the decreased incidence of the spark discharges occurs. In other words, an increased quantity of the platinum component of the tip 13 resides in a portion corresponding to an upper limit of the firing end 12 of the metal column 11. Conversely, a decreased quantity of the platinum component of the tip 13 resides in a portion corresponding to a lower limit of the firing end 12 of the metal column 11.

Due to the increased number of cycles of spark discharges between the inner wall 4*a* of the ground electrode 4 and the noble metal tip 13 caused by extending the use of the circular discharge type spark plug 1, the inner wall 4*a* of the ground electrode 4 and the noble metal tip 13 provided on the firing end 12 of the metal column 11. The spark erosion of the tip 13 depends on the platinum component and the incidence of the spark discharges to which the tip 13 is subjected. This means that there is no significant difference between the spark erosion of the tip portion to which the increased spark discharge incidence and increased platinum component are subjected and the spark erosion of the tip portion to which the decreased spark discharge incidence and decreased platinum component are subjected. The eroded layer of the tip 13 is uniformly retained all through the firing end 12 of the metal column 11 when the circular discharge type spark plug 1 exhausts its service life.

As described above, the tip 13 is uniformly eroded all through the firing end 12 of the metal column 11 when repeated spark discharge is induced between the inner wall 4*a* of the ground electrode 4 and the noble metal tip 13 provided on the firing end 12 of the metal column 11. This enables a reduction in the quantity of the expensive platinum component used at the tip portion to which the decreased incidence of the spark discharges is subjected without disadvantageously losing the spark erosion resistant property. This results in a long service life of the spark plug with a minimum use of the expensive platinum, thus significantly reducing a manufacturing cost for mass production in industrial applications.

Further, as previously shown in FIG. 2, the greatest quantity of the platinum component of the tip 13 is approximately 85% by weight, while the least quantity of the platinum component of the tip 13 is approximately 70% by weight. Thus, a difference between upper and lower limits of the platinum component is about 15% by weight. This maintains a good spark erosion resistant property of the tip portion to which the decreased incidence of the spark discharges is subjected. It is possible to satisfactorily retain the above advantages by insuring the difference of 15% by weight between the upper and lower limits of the platinum component of the tip 13.

In addition, the platinum component of the tip 13 changes in the axial direction of the metal column 11, thereby dispersing thermal stress which would otherwise work locally on the tip 13 due to repeated heat-and-cool cycles while the circular discharge type spark plug 1 is in service. This arrangement also decreases the thermal expansion difference between the tip 13 and the metal column 11, which also reduces the thermal stress. This also prevents cracks from developing on an interface between the tip 13 and the metal column 11, and prevents the tip 13 from inadvertently falling off the metal column 11.

Figure 5:
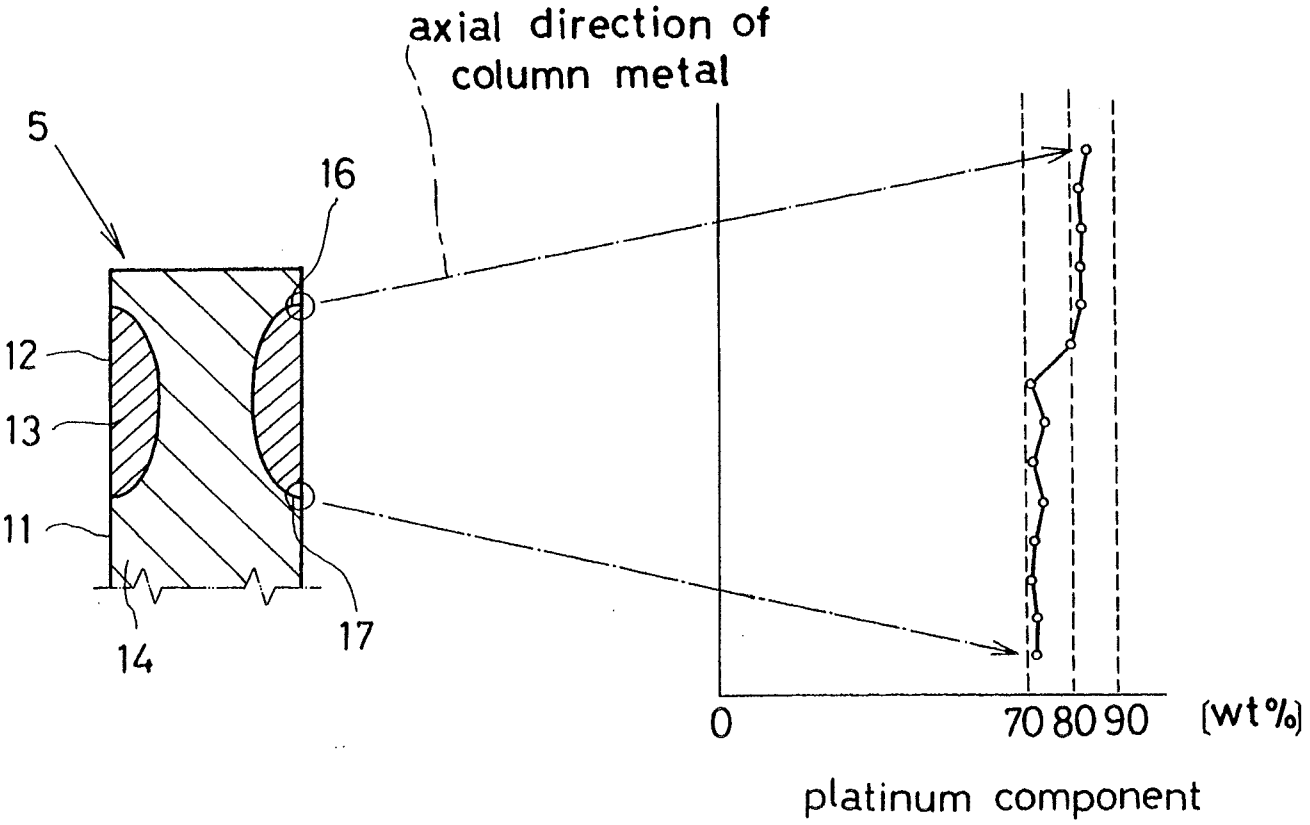
FIG. 5 is a graph showing a relationship between a platinum containing rate (wt %) and an axial position of a noble metal alloyed tip to which varied spark discharges are subjected according to a second embodiment of the invention.

FIG. 5 is a graph showing how the platinum component changes depending on the position of the tip 13 according to a second embodiment of the invention.

In this embodiment of the invention, an increased quantity of the platinum component of the tip 13 resides in a portion corresponding to an upper limit of the firing end 12 of the metal column 11. A decreased quantity of the platinum component of the tip 13 resides in a portion corresponding to a lower limit of the firing end 12 of the metal column 11. The platinum component of the tip 13 is adapted to abruptly change between the portions corresponding to the upper and lower limits of the firing end 12 of the column metal 11.

The greatest quantity of the platinum component of the tip 13 is approximately 83% by weight, while the least quantity of the platinum component of the tip 13 is approximately 71% by weight. This concludes that the difference between the upper and lower limits of the platinum component is about 12% by weight. This arrangement makes it possible to insure the same advantages as obtained by the first embodiment of the invention since the difference between the upper and lower limits of the platinum component is 10% by weight or more.

It is noted that the noble metal tip 13 may be used in a full creeping discharge type spark plug.

Figure 6:
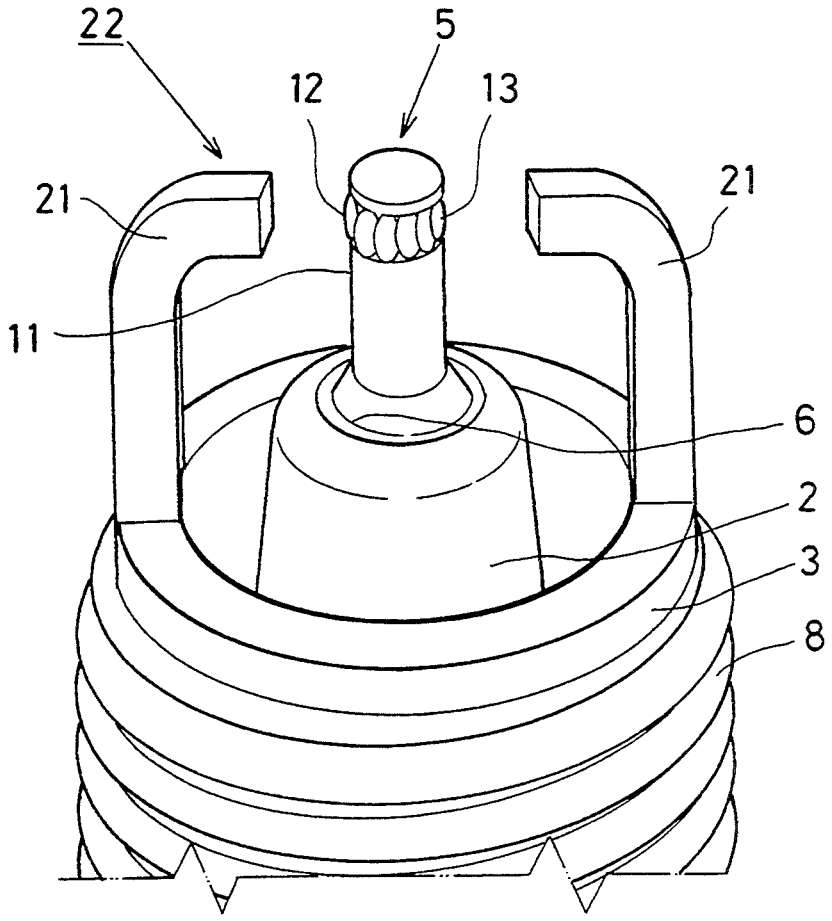
FIG. 6 is a perspective view of a lower portion of a multi-polarity type spark plug according to a third embodiment of the invention.

FIG. 6 shows a third embodiment of the invention in which a multi-polarity type spark plug 22 is used with paired ground electrodes 21 extended into the combustion chamber of the internal combustion engine. The noble metal tip 13 is welded to the metal column 11 of the center electrode 5 in the same manner as described with respect to the first and second embodiments of the invention.

Figure 7:
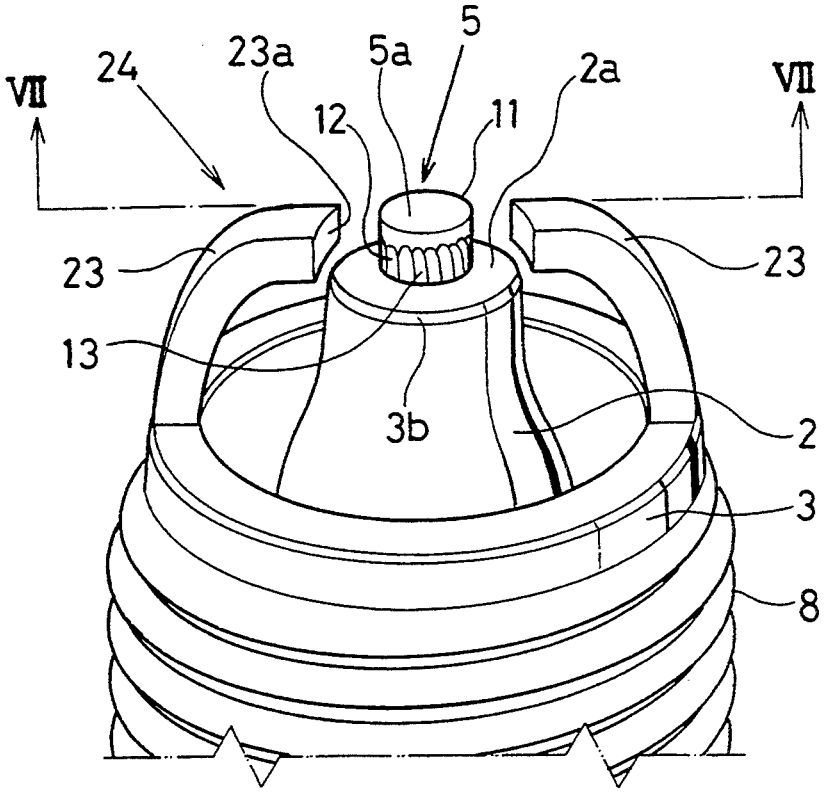
FIG. 7 is a perspective view of a lower portion of a semi-creeping discharge type spark plug according to a fourth embodiment of the invention.
Figure 8:
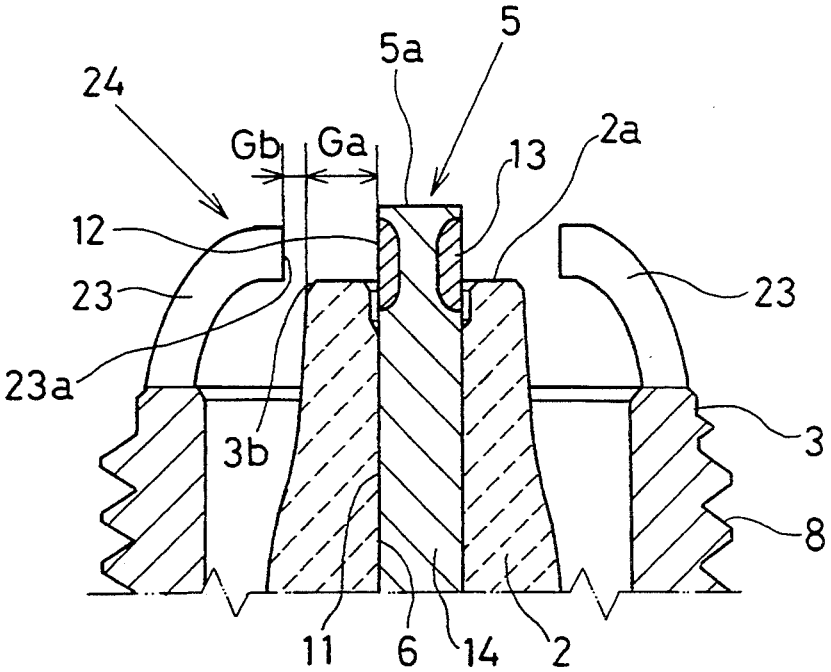
FIG. 8 is a longitudinal cross sectional view taken along the line VII—VII of FIG. 7.
Figure 9:
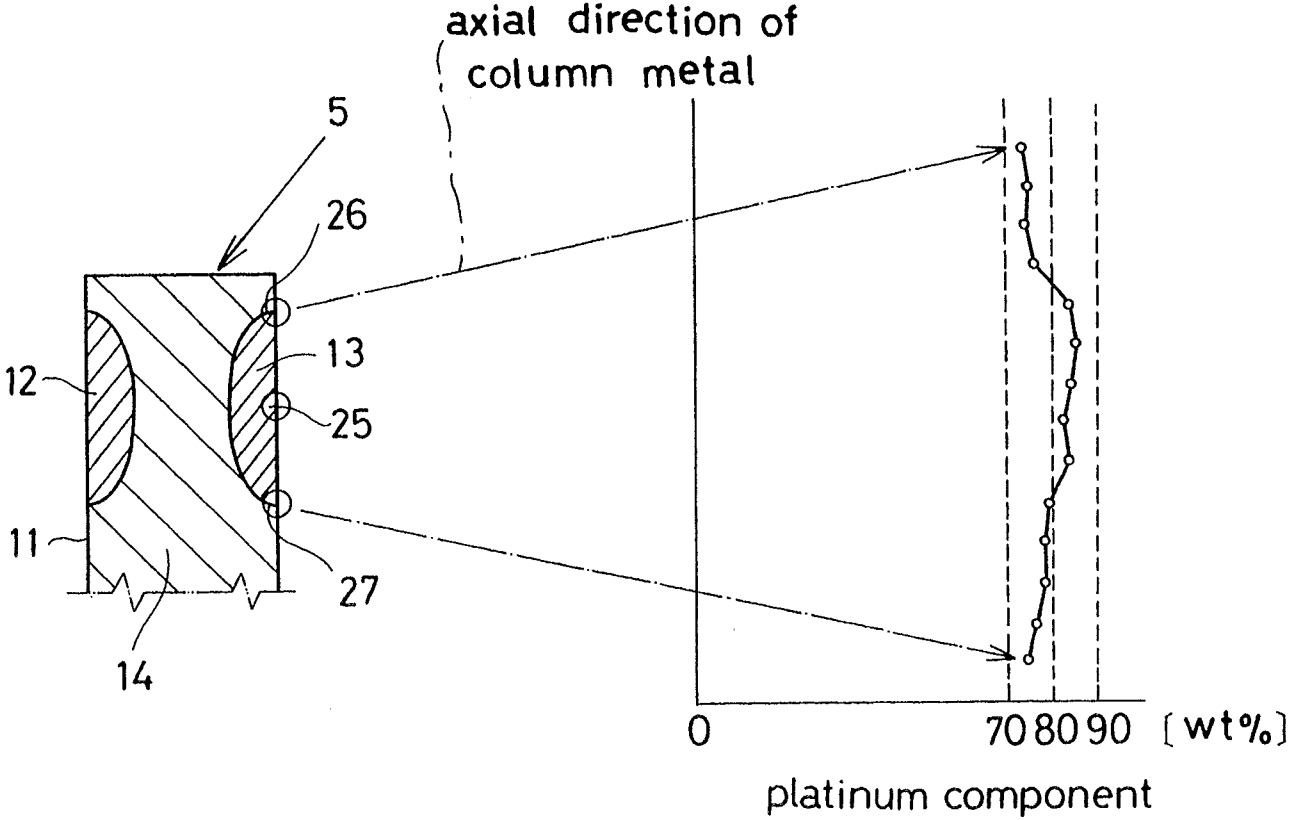
FIG. 9 is a graph showing a relationship between a platinum containing rate (wt %) and an axial position of a noble metal alloyed tip to which varied spark discharges are subjected according to the semi-creeping discharge type spark plug shown in FIG. 7.

FIGS. 7 through 9 show a fourth embodiment of the invention which is applied to a semi-creeping discharge type spark plug 24. In this embodiment of the invention, a discharge gap (Ga) is provided which creeps between a front end surface 5*a* of the center electrode 5 and a discharge end 23*a* of a ground electrode 23 along a front end surface 2*a* of the insulator 2. An air gap (Gb) is provided between the discharge end 23*a* of the ground electrode 23 and an outer surface 3*b* of the insulator 2.

The noble metal alloy tip 13 is made of a corrosion and erosion resistant platinum (Pt) or platinum alloy containing Ni and Ir, and formed into an annular configuration as shown in FIGS. 3*a*~3*c*. With an experiment carried out to previously measure the incidence of spark discharges subjected to the tip 13, the noble metal component of the tip 13 is designed to change according to an axial position on the elongated metal column 11 on the basis of the incidence of the spark discharges subjected to a specified portion of the tip 13. Consequently, the platinum component of the tip 13 increases in which the incidence of the spark discharges increases as shown at numeral 16 (the upper limit) in FIG. 2. Conversely, the platinum component of the tip 13 decreases in which the incidence of the spark discharges decreases as shown at numeral 17 (the lower limit) in FIG. 2.

In the noble metal tip 13 welded to the firing end 12 of the metal column 11 in the semi-creeping discharge type spark plug 24, the platinum component of the tip 13 is increased in the direction in which the increased incidence of the spark discharges occurs, while the platinum component of the tip 13 is decreased in the direction in which the decreased incidence of the spark discharges occurs. Namely, as shown in FIG. 9, an increased quantity of the platinum component of the tip 13 resides in a portion 25 corresponding to a central area of the firing end 12 of the metal column 11. Conversely, a decreased quantity of the platinum component of the tip 13 resides in portions 26, 27 corresponding to the upper and lower limits, respectively, of the firing end 12 of the column metal 11.

In this instance, the greatest quantity of the platinum component of the tip 13 is approximately 86% by weight, while the smallest quantity of the platinum component of the tip 13 is approximately 72% by weight. A difference between the central portion 25 and upper/lower limits of the platinum component is therefore about 14% by weight.

Figure 10:
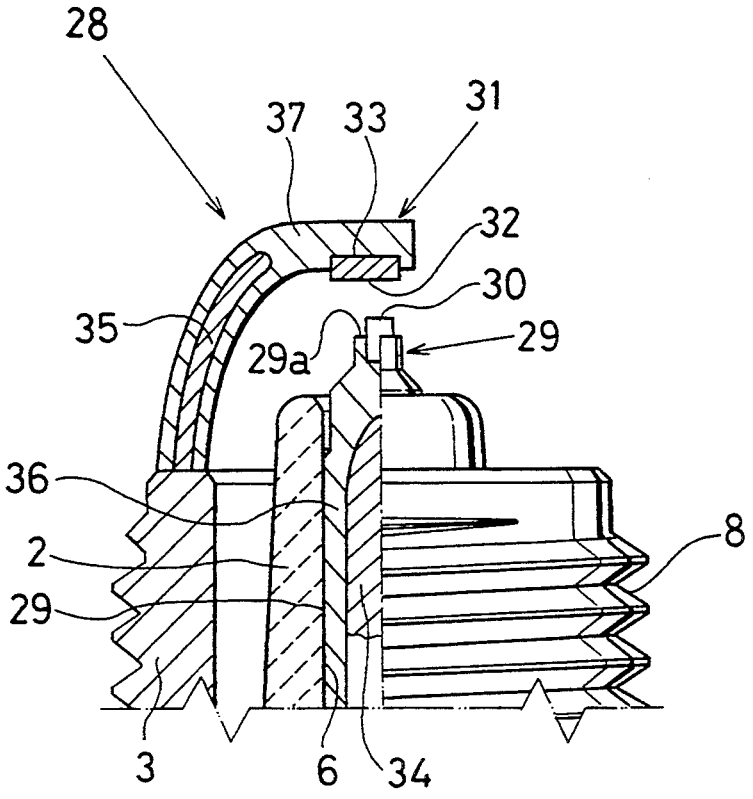
FIG. 10 is a longitudinal cross sectional view of a lower portion of a spark plug according to a fifth embodiment of the invention.
Figure 11:
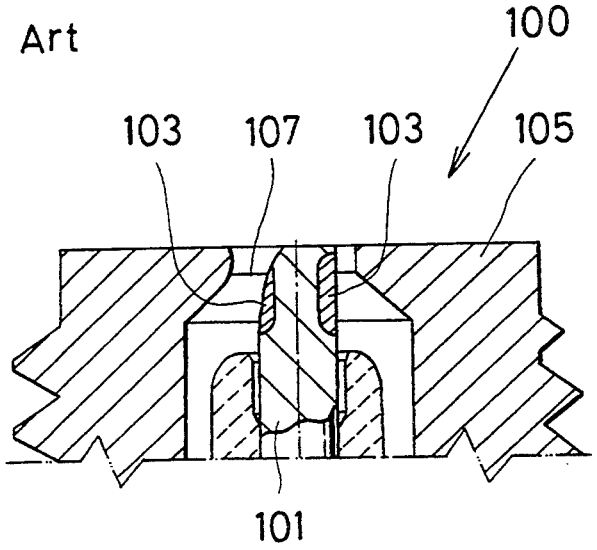
Fig. 11 Prior Art
FIG. 11 is a longitudinal cross sectional view of a lower portion of a conventional spark plug showing how a noble metal tip is spark eroded.
Figure 12:
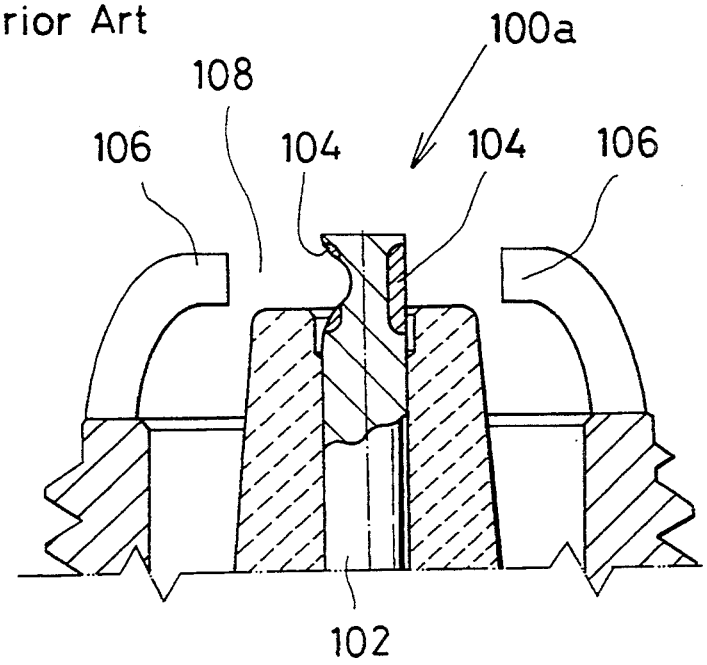
Fig. 12 Prior Art
FIG. 12 is a longitudinal cross sectional view of a lower portion of another conventional spark plug showing how a noble metal tip is spark eroded.
Figure 13A:
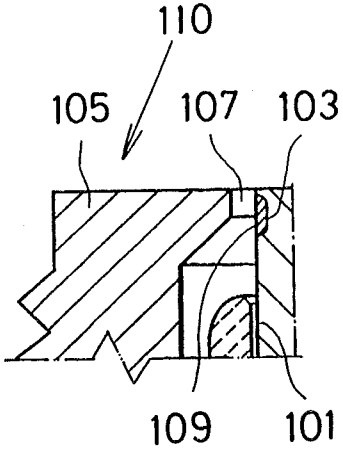
Fig. 13a Prior Art
FIGS. 13a~13d are sequential views showing how a center electrode is spark eroded according to the conventional spark plug shown in FIG. 11.
Figure 13B:
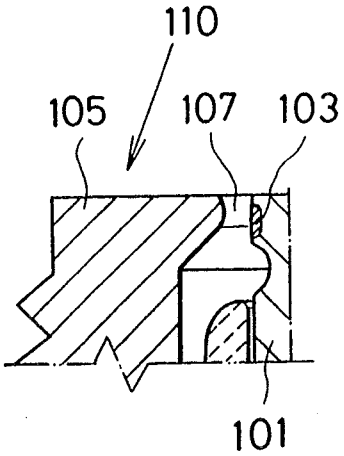
Fig. 13b Prior Art
Figure 13C:
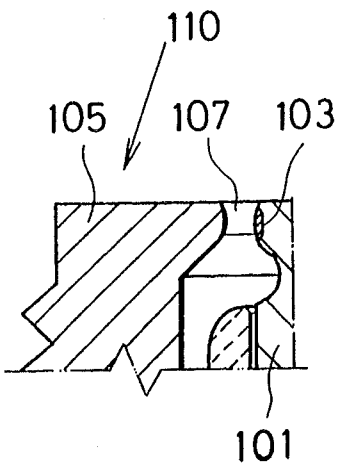
Fig. 13c Prior Art
Figure 13D:
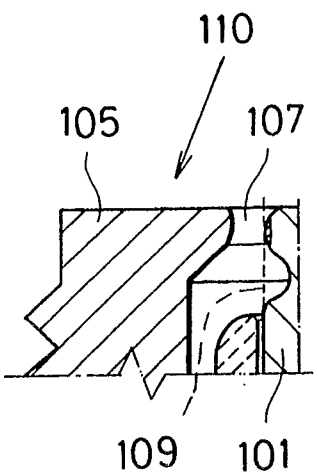
Fig. 13d Prior Art

FIG. 10 shows a fifth embodiment of the invention in which an iridium (Ir) or iridium-alloyed (Ir—$Y_2O_3$, Ir—$La_2O_3$, Ir—$ZrO_2$) layer 30 is secured to a front end surface 29*a* of a center electrode 29 by means of laser welding, electrical resistance welding or the like.

In a spark plug 28 according to the fifth embodiment of the invention, a corrosive and erosion resistant platinum-alloyed tip 33 is secured to a firing end 32 of a ground electrode 31 by means of the laser welding. The center electrode 29 has a heat-conductive core 34 cladded by a metal column 36, while the ground electrode 31 has a heat-conductive core 35 cladded by a column metal 37.

As apparently from the foregoing description, the noble metal component of the tip is changed depending on the magnitude of spark discharges to which the tip portion is subjected. Thus, the eroded layer of the tip is uniformly retained all through the firing end 12 of the metal column 11 when the spark plug exhausts its service life. This enables a reduction in the quantity of the expensive platinum component used at the tip portion to which the decreased incidence of the spark discharges is subjected without disadvantageously losing the spark erosion resistant property. This results in a long service life of the spark plug with a minimum use of the expensive platinum, thus significantly reducing a manufacturing cost for mass production in industrial applications.

It is noted that the tip may be made of gold, palladium, iridium, rhodium or the like instead of the platinum metal used for the noble metal tip 13 according to each of the embodiments of the invention.

It is also noted that the ground electrode 4 may be discretely prepared with its spark erosion taken into consideration instead of making it integral with the metallic shell 3 in the first embodiment of the invention.

It is observed that the noble metal tip may be used on a firing end of the ground electrode in the first through fourth embodiment of the invention.

It is also observed that instead of the noble metal layer 30, the noble metal tip 33 may be used on the front end surface 29*a* of the center electrode 29.

It is appreciated that the platinum component of the tip 13 may be altered in its axial direction according to a spark erosion pattern predetermined on an experimental test result in which the noble metal tip is actually eroded in the first, second and fourth embodiments of the invention.

It is also appreciated that the platinum component of the tip 13 welded to the ground electrode may be altered in its radial direction according to the spark erosion of a firing portion of the ground electrode.

Further, it is observed that a noble tip may be previously made in which the platinum component is altered in its axial direction depending on the magnitude of the spark discharges to which the tip portion is subjected, and thereafter the tip may be secured to the firing end 12 of the metal column 11 of the center electrode 5 by means of the electrical resistance welding or the like.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. In a spark plug electrode in which an alloyed tip is secured to a firing end of at least one of opposed electrodes forming a spark gap therebetween, the tip comprising a spark-erosion resistant noble metal component:

the noble metal component varying as a weight percentage of the alloyed tip in an axial direction of the electrode depending on a magnitude of spark discharges to which a specified portion of the tip is subjected between the opposed electrodes, wherein a largest weight percentage of the noble metal component is provided at areas on the electrode subjected to relatively high magnitude spark discharges, and wherein a smallest weight percentage of the noble metal component is provided at areas on the electrode subjected to relatively low magnitude spark discharges.

2. In a spark plug electrode in which an alloyed tip is secured to a firing end of at least one of opposed electrodes forming a spark gap therebetween, the tip comprising a spark-erosion resistant noble metal component:

the noble metal component varying as a weight percentage of the tip in an axial direction of the electrode depending on a quantity of spark erosion to which a specified portion of the tip is subjected between the opposed electrodes, wherein a largest weight percentage of the noble metal component is provided at areas on the electrode subjected to relatively high quantities spark erosion, and wherein a smallest weight percentage of the noble metal component is provided at areas on the electrode subjected to relatively low quantities spark erosion.

3. In a spark plug electrode as recited in claim 1 or 2, wherein a difference between the largest and smallest weight percentage of the noble metal component of the alloyed tip is at least 10% by weight.

4. In a spark plug electrode as recited in claim 1 or 2, wherein the alloyed tip comprises a platinum-based alloy containing nickel and iridium.

5. In a spark plug electrode as recited in claim 1 or 2, wherein the electrode comprises a clad metal and a heat-conductive core concentrically embedded in the clad metal.

6. In a spark plug electrode as recited in claim 5, wherein the clad metal comprises a corrosion and erosion resistant nickel alloy containing 15.0 wt % Cr and 8.0 wt % Fe, and the heat-conductive core comprises one of silver and copper.

7. In a spark plug electrode as recited in claim 1 or 2, wherein the smallest weight percentage of the noble metal component is approximately 70% at a proximal end of the alloyed tip, and wherein the largest weight percentage of the noble metal component is approximately 85% at a distal end of the alloyed tip, with a gradual increase in the weight percentage of the noble metal component from the proximal end to the distal end of the alloyed tip.

8. In a spark plug electrode as recited in claim 1 or 2, wherein the smallest weight percentage of the noble metal component is approximately 71% at a proximal end of the alloyed tip, and wherein the largest weight percentage of the noble metal component is approximately 83% at a distal end of the alloyed tip, and wherein the weight percentage of the noble metal component remains relatively constant in the axial direction at the lowest weight percentage from the proximal end to a point between the proximal and distal ends, and wherein the percentage of the noble metal component thereafter abruptly increases to the largest weight percentage.

9. In a spark plug electrode as recited in claim 1 or 2, wherein the smallest weight percentage of the noble metal component is approximately 72% at distal and proximal ends of the alloyed tip, and wherein the largest weight percentage of the noble metal component is approximately 86% at a point substantially midway between the distal and proximal ends, the weight percentage of the noble metal component gradually decreasing from 86% at the point substantially midway between the distal and proximal ends to 72% at the distal and proximal ends, respectively.

* * * * *